US006685534B2

(12) United States Patent
Mitchell et al.

(10) Patent No.: US 6,685,534 B2
(45) Date of Patent: Feb. 3, 2004

(54) ADJUSTABLE CIRCULAR KNIT BRA WITH STABILIZING AREAS AND METHODS OF MAKING THE SAME

(75) Inventors: John Mitchell, Asheboro, NC (US); Sandra Ann Waitz, Dingmans Ferry, PA (US)

(73) Assignee: Sara Lee Corporation, Winston-Salem, NC (US)

( * ) Notice: Subject to any disclaimer, the term of this patent is extended or adjusted under 35 U.S.C. 154(b) by 36 days.

(21) Appl. No.: 10/002,610

(22) Filed: Oct. 31, 2001

(65) Prior Publication Data

US 2003/0082994 A1 May 1, 2003

(51) Int. Cl.[7] ..... A41C 3/00
(52) U.S. Cl. ..... 450/74; 450/92
(58) Field of Search ..... 450/1, 41, 45–47, 450/51–53, 65, 66, 74–76, 92; 66/170, 171, 172 E, 176, 177

(56) References Cited

U.S. PATENT DOCUMENTS

| | | | | | |
|---|---|---|---|---|---|
| 1,156,808 | A | | 10/1915 | Perillat | |
| 1,264,337 | A | | 4/1918 | Scognamillo | |
| D103,068 | S | | 2/1937 | Rosenthal | |
| 2,287,769 | A | | 6/1942 | Alberts | |
| 2,352,866 | A | | 7/1944 | Stacy | |
| 2,411,462 | A | | 11/1946 | Plehn | |
| 2,481,603 | A | | 9/1949 | Cascio | |
| 2,763,865 | A | | 9/1956 | Holt | |
| 2,874,764 | A | | 3/1959 | Benson | |
| 2,884,927 | A | | 5/1959 | Goldstein | |
| 2,912,985 | A | * | 11/1959 | Plehn | 450/74 |
| 3,019,792 | A | | 2/1962 | Kahn | |
| 3,094,991 | A | * | 6/1963 | Smith | 450/65 |
| 3,101,717 | A | | 8/1963 | Korman | |
| 3,295,529 | A | | 1/1967 | Corrigall et al. | |
| 3,320,959 | A | | 5/1967 | Fridolph | |
| 3,322,127 | A | * | 5/1967 | Sachs | 450/74 |
| 3,372,698 | A | | 3/1968 | Gingras | |
| 3,393,681 | A | | 7/1968 | Sachs | |
| 3,430,632 | A | | 3/1969 | James et al. | |
| 3,500,665 | A | | 3/1970 | Braxton et al. | |
| 3,537,279 | A | | 11/1970 | Epley | |
| 3,559,653 | A | | 2/1971 | Jannicelli, Jr. | |
| 3,665,929 | A | | 5/1972 | Brantly | |
| 3,746,008 | A | | 7/1973 | Cascio et al. | |
| 3,817,255 | A | | 6/1974 | Cascio | |
| D243,722 | S | | 3/1977 | Poirier | |
| D256,288 | S | | 8/1980 | Stern et al. | |
| 4,217,905 | A | | 8/1980 | Atwater et al. | |
| 4,444,192 | A | | 4/1984 | Stern et al. | |
| 4,453,549 | A | | 6/1984 | DiTullio | |
| 4,531,525 | A | | 7/1985 | Richards | |
| 4,632,118 | A | | 12/1986 | Garutso | |
| D295,340 | S | | 4/1988 | Shonk | |
| 4,767,377 | A | | 8/1988 | Falla | |
| D319,330 | S | | 8/1991 | Akazaki et al. | |
| 5,479,791 | A | | 1/1996 | Osborne | |
| 5,553,468 | A | * | 9/1996 | Osborne | 450/74 |
| 5,592,836 | A | | 1/1997 | Schuster et al. | |
| 5,605,060 | A | | 2/1997 | Osborne | |
| 5,669,247 | A | | 9/1997 | McCartney et al. | |
| 5,850,745 | A | | 12/1998 | Albright | |
| 5,946,944 | A | | 9/1999 | Osborne | |
| 6,287,168 | B1 | * | 9/2001 | Rabinowicz | 450/74 |

FOREIGN PATENT DOCUMENTS

| | | |
|---|---|---|
| DE | 2541440 | 3/1977 |

* cited by examiner

*Primary Examiner*—Gloria M. Hale
(74) *Attorney, Agent, or Firm*—Ohlandt, Greeley, Ruggiero & Perle, L.L.P.

(57) ABSTRACT

An adjustable circular knit bra is provided. The bra has a pair of breast cups, a central gore disposed between the breast cups, and a pair of side panels. Each side panel is adjacent to a different one of the pair of breast cups. The central gore also has a stabilizing area knitted therein. The breast cups also have a stabilizing area knitted into the bottom edge of each breast cup. The bra preferably also has a pair of adjustable shoulder straps. The bra preferably also has adjustable fasteners at the bra back.

23 Claims, 7 Drawing Sheets

ADJUSTABLE CIRCULAR KNIT BRA WITH STABILIZING AREAS AND METHODS OF MAKING THE SAME

BACKGROUND OF THE INVENTION

1. Field of the Invention

The present invention relates to bras or brassieres. More particularly, the present invention relates to an adjustable circular knit bra having a stabilizing area located at the center between the breast cups, and each breast cup provides support while permitting flexibility.

2. Description of the Prior Art

Modern bras are designed to accommodate both a need for comfort during wear as well as a need for support. A bra must therefore provide flexibility, freedom of movement, and breast support.

Circular knit bras have become popular for the maximum comfort and flexibility that they provide. Circular knit technology has been used to create bras that accommodate a need for maximum stretchability and freedom of movement, such as sports bras.

U.S. Pat. No. 4,531,525 to Richards describes the use of a circular knitting machine to produce a seamless garment blank. To assemble a bra, the seamless garment blank is cut, folded, and sewn.

U.S. Pat. No. 5,592,836 to Osborne describes a bra made from a circular-knit garment blank. Each circular-knit garment blank has a welt at one end with a fabric portion integrally knit thereto. To assemble the bra, neck and armhole areas are cut in the fabric segment to define front and rear strap portions, which are sewn to complete the formation of the bra. Full cup support areas are provided in each breast cup region by adding fed-in yarns in the knitting process.

U.S. Pat. No. 5,850,745 to Albright provides a circular knit bra that is elasticized by the selective insertion of elastic yarn segments in selected wales and courses, to define the contoured area to be elasticized.

While bras of circular knit construction have become popular for the maximum comfort and flexibility desirable in an undergarment, they provide little support in the breast area. Additionally, traditional circular knit bras do not provide support in the area between the breast cups. Therefore, a need still exists for a circular knit bra having support areas of increased stability, thereby providing a comfortable bra that provides the additional breast support necessary during activity. Moreover, because circular knit bras lack adjustment means, it may not be possible for every woman to find a circular knit bra of appropriate size. A need therefore exists for an adjustable circular knit bra that provides superior fit.

SUMMARY OF THE INVENTION

It is an object of the present invention to provide a seamless circular knit bra having stabilizing areas in the center gore as well as in the breast cups.

It is another object of the present invention to provide such a bra that provides increased support and stability in the bra without gathering or puckering.

It is still another object of the present invention to provide a method of making a seamless circular knit bra having integrally knitted stabilizing areas using a minimal number of manufacturing steps.

It is yet another object of the present invention to provide a seamless circular knit bra that has adjustable shoulder straps and side panels, thereby allowing the adjustment necessary to better fit and comfort.

These and other objects and advantages of the present invention are achieved by a bra or brassiere formed of a circular knit bra blank that is cut to define a traditionally shaped bra body having a pair of breast cups, a center gore or portion disposed between the breast cups, and a pair of side panels to connect each breast cup to the back of the brassiere. The center gore, located between the breast cups, is integral to the overall stability of the front of the brassiere. The central gore of the present invention is strengthened by a stitching method that yields a stabilizing area that is less stretchable than the body of the brassiere. The stabilizing area provides stretch resistance that conforms to the movement of the body, thereby increasing support and comfort for the wearer. The brassiere of the present invention further comprises breast cups with similarly knitted in crescent shaped stabilizing areas, located on or adjacent the bottom edge of the breast cups, thereby providing support for the breasts. In a preferred embodiment, the brassiere may include a pair of adjustable shoulder straps with each strap connected to a breast cup and a side panel. The brassiere may also have a pair of arcuate underwire portions, with one arcuate underwire portions adjacent or connected to each breast cup to provide additional breast support.

BRIEF DESCRIPTION OF THE DRAWINGS

The foregoing and still other objects and advantages of the present invention will be more apparent from the following detailed explanation of the preferred embodiments of the invention in connection with the accompanying drawings.

DETAILED DESCRIPTION OF THE INVENTION

Figure 1:
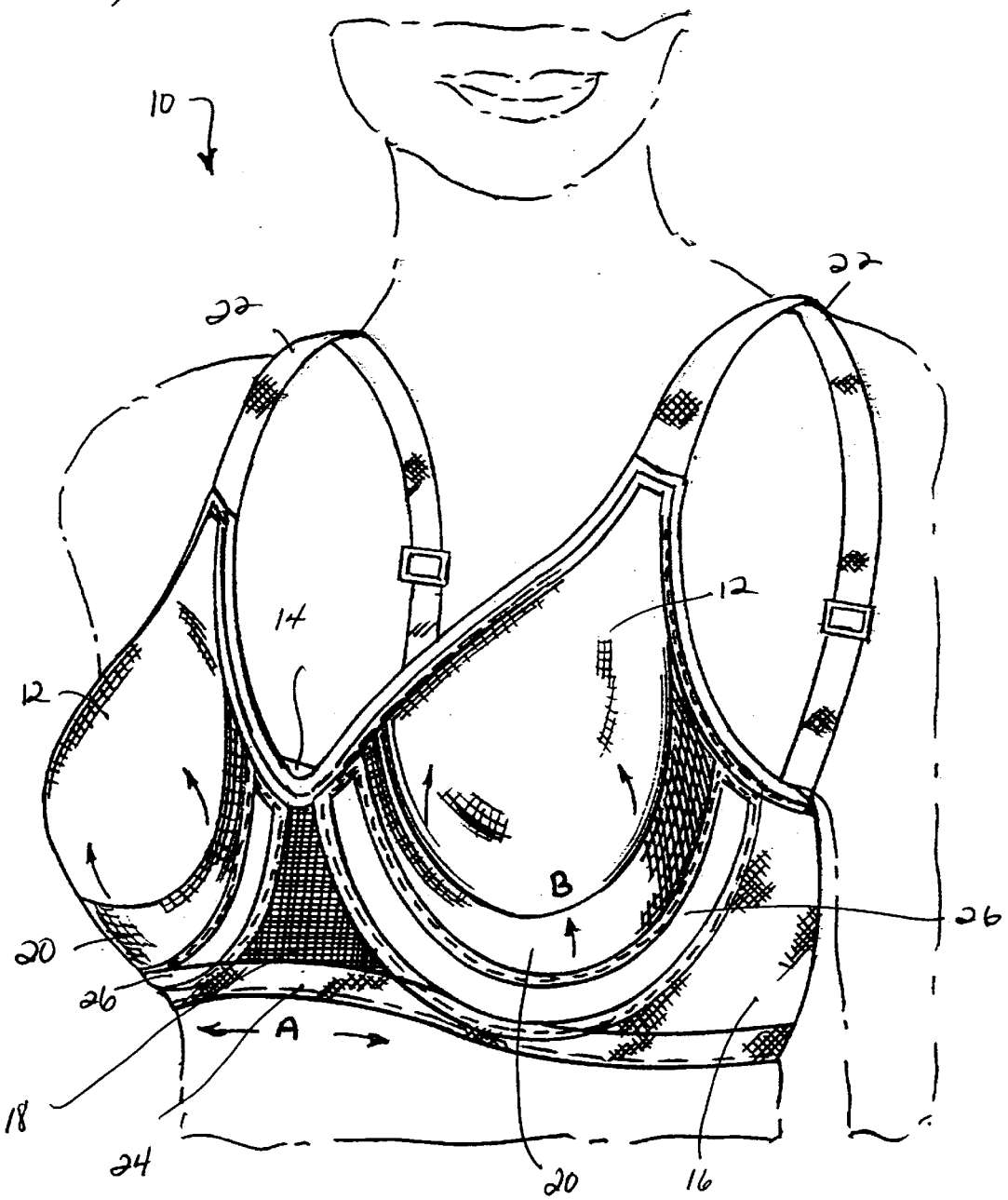
FIG. 1 illustrates a perspective view of a brassiere according to the present invention.
Figure 2:
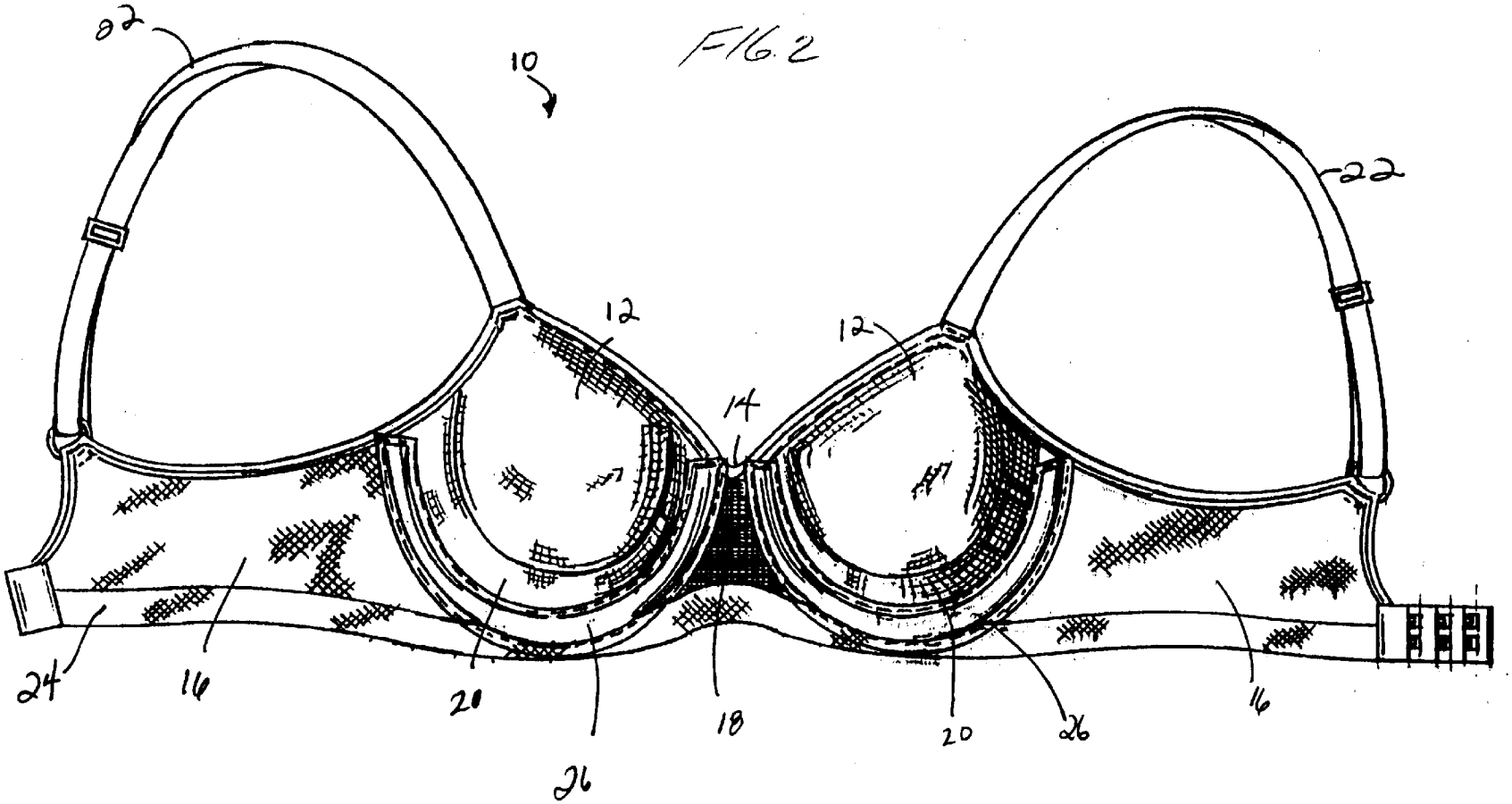
FIG. 2 illustrates a top plan view of a brassiere according to the present invention.
Figure 3:
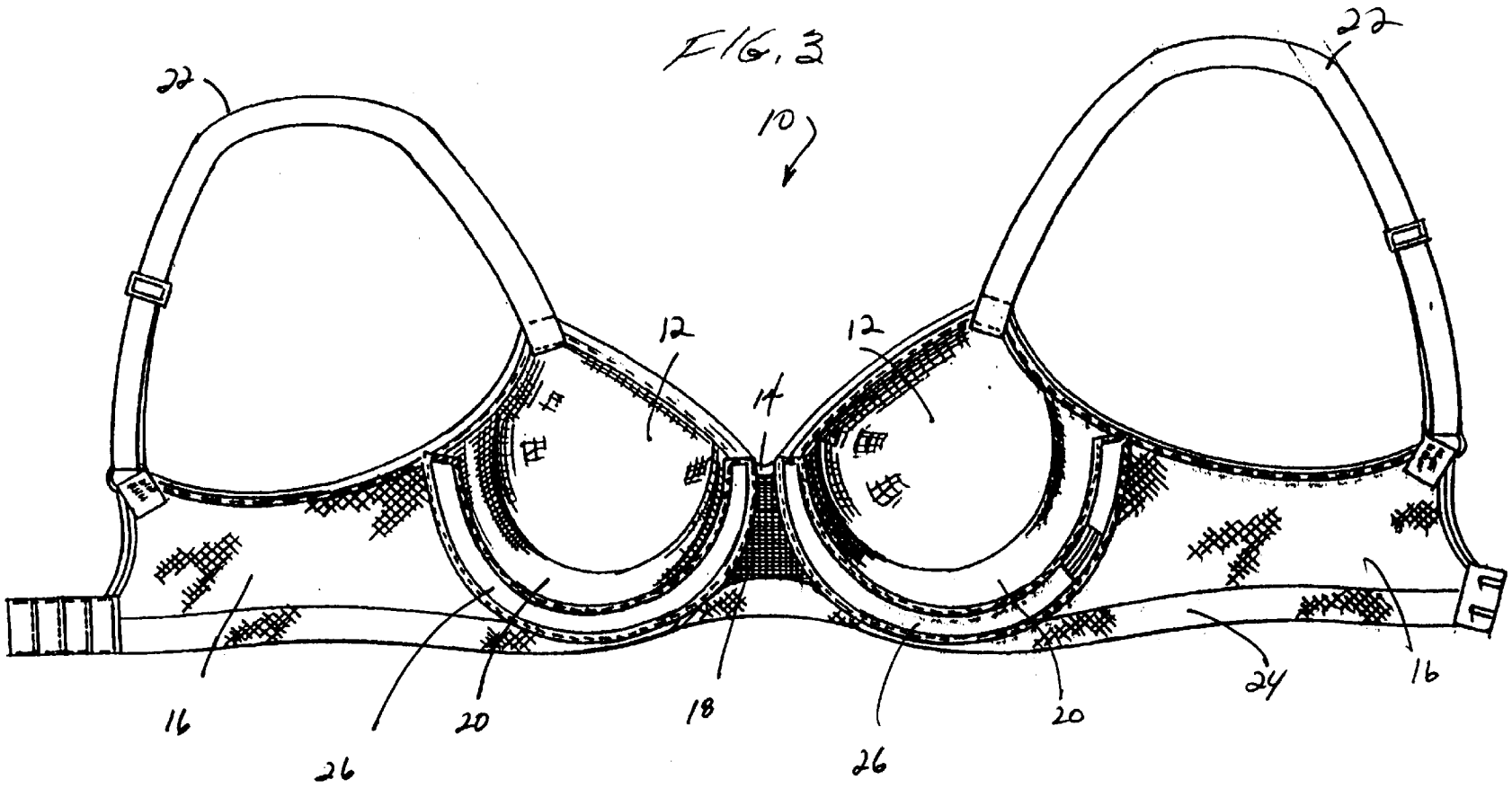
FIG. 3 illustrates a bottom plan view of a brassiere according to the present invention.

Referring to the drawings and, in particular, FIGS. 1 to 3, there is illustrated a bra or brassiere according to the present invention generally represented by reference numeral 10. Brassiere 10 is preferably formed from a unitary, seamless circular knit bra blank. However, brassiere 10 can be made of two or more layers. The knit construction of the body of the brassiere 10 may be formed of one or any combination of conventional knit stitches.

The outline of brassiere 10 is cut from the bra blank to provide a pair of breast cups 12, a center gore or panel 14 positioned between the breast cups, and a pair of side panels or portions 16, each side panel being adjacent at one end to a different breast cup and at the other end adapted to be connected the other side panel. Side panels 16 are removably joined together at the back of the wearer by conventional fasteners, such as, for example, hook-and-eye, snap and VELCRO® closures.

Center gore 14 has a knitted-in stabilizing or stabilizing area 18 positioned in the center gore. As shown in FIG. 1, the stabilizing area 18 is less stretchable than the body of brassiere 10, while maintaining some stretchability in direction A, as illustrated in FIG. 1. Each breast cup 12 has a knitted-in stabilizing area 20 positioned on the lower margins of each breast cup. The stabilizing areas 20 of the breast cups 12 are less stretchable than the body of brassiere 10, while maintaining some stretchability in direction B, as illustrated in FIG. 1.

Figure 4:
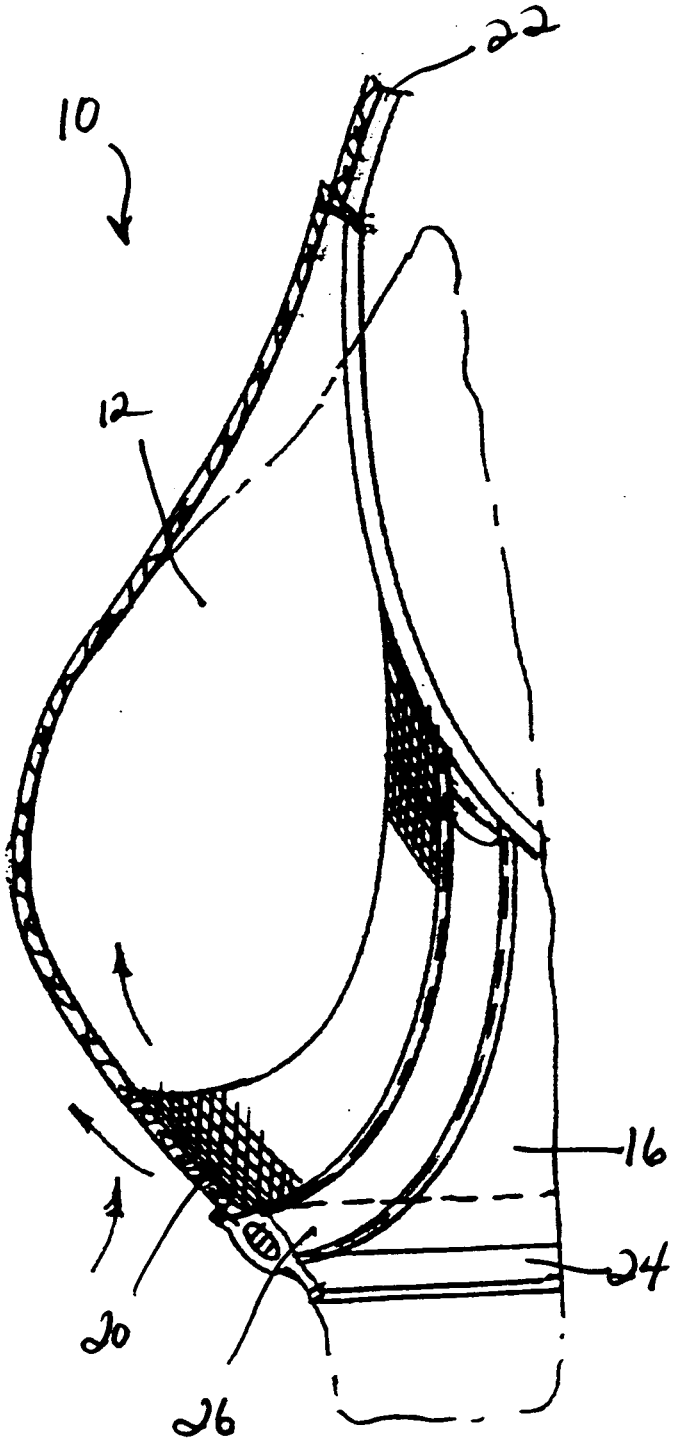
FIG. 4 illustrates a side view of a brassiere of the present invention.

Referring to FIG. 4, stabilizing areas 20 in the breast cups 12 preferably have an anatomically desired shape that enhances support, natural shaping and comfort. More preferably, the stabilizing areas 20 are crescent-shaped curves disposed on the bottom edge of the breast cups, with the most support being in the portion of the crescent adjacent the underarm area.

Figure 5:
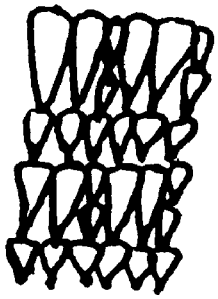
FIG. 5 illustrates a view of the wale and course stitching pattern of the center gore of the brassiere.

Stabilizing areas 18, 20 are knitted in during the knitting process using a positive float needle selection. This selection causes the selected areas to become tighter and more rigid. The use of a positive float needle selection, by carrying stitches over, creates less gathering and puckering than would a drop stitch method. Thus, a smooth, finished look is provided to brassiere 10. By way of example, but without limitation, one acceptable stitch pattern for central gore stabilizing area 18 provides a 1 by 2 (1×2) positive float stitch pattern on every other course, as illustrated in FIG. 5. The 1×2 positive float stitch pattern increases the modulus of the fabric, thereby providing increased stability while allowing some stretchability in center gore 14. The maximum stretch of the stabilizing area 18 of center gore 14 is 125% walewise and coursewise of the initial, unstretched position.

Figure 7A:
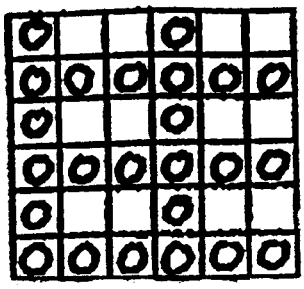
FIG. 7*a* is an alternative view of the wale and course stitch pattern of the central gore of the brassiere.
Figure 7B:
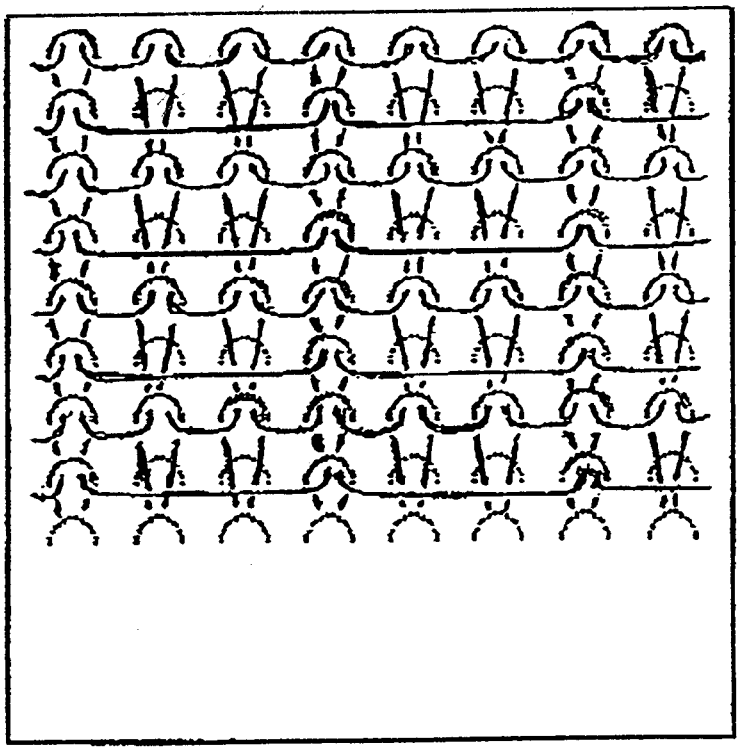
FIG. 7*b* is a diagram of the knit structure of the central gore of the brassiere.

FIG. 7*a* is a diagram which further illustrates the 1×2 positive float stitch pattern on every other course of the stabilizing area of the central gore. The circles represent stitches, while the blank squares represent areas where stitches are carried over. FIG. 7*b* is a diagram of the knit structure of the 1×2 positive stitch pattern on every other course of the stabilizing area of the central gore.

Figure 6:
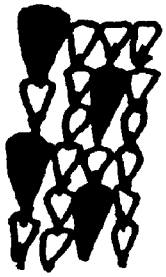
FIG. 6 illustrates a view of the wale and course stitching pattern of the breast cups of the brassiere.

By way of example, but without limitation, one acceptable stitch pattern for stabilizing areas 20 of each breast cup 12 provides a targeted needle selection. This selection is a 3×1 alternating positive float stitch pattern on every course, as illustrated in FIG. 6. The maximum stretch of the stabilizing area 20 of breast cup 12 is 150% walewise and coursewise of the initial, unstretched position.

Figure 8A:
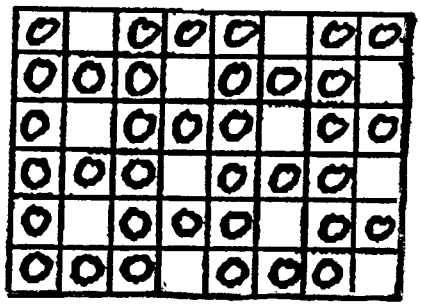
FIG. 8*a* is an alternative view of the wale and course stitch pattern of the breast cups of the brassiere.
Figure 8B:
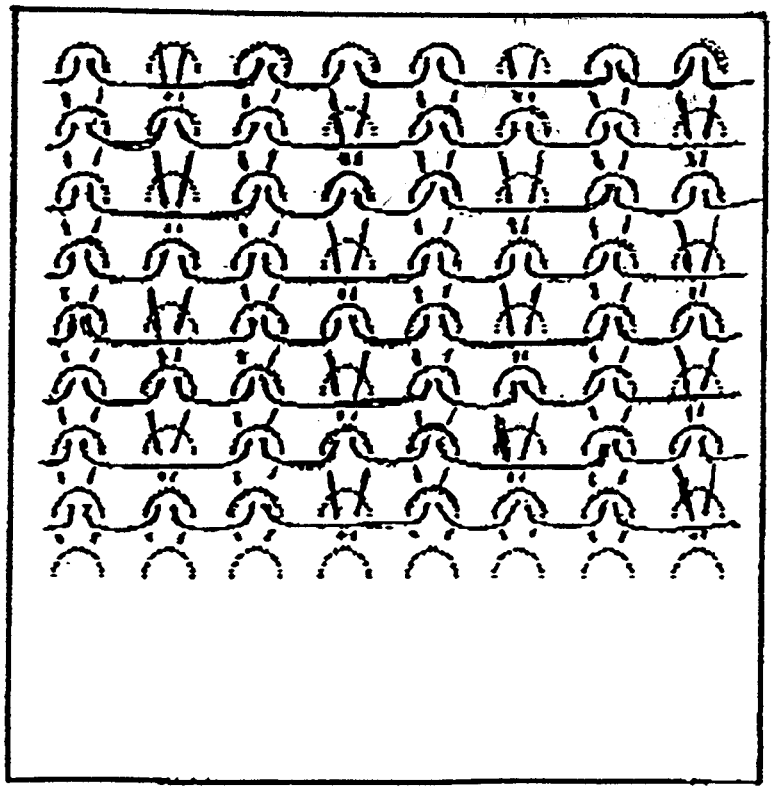
FIG. 8*b* is a diagram of the knit structure of the breast cups of the brassiere.

FIG. 8*a* is a diagram which further illustrates the 3×1 positive float stitch pattern on every other course of the stabilizing area of the breast cups. The circles represent stitches, while the blank squares represent areas where stitches are carried over. FIG. 8*b* is a diagram of the knit structure of the 3×1 positive stitch pattern on every other course of the stabilizing area of the breast cups.

The center gore and breast cup stabilizing areas 18, 20, respectively, of present invention are not restricted to these particular stitch patterns. Various other stitch patterns could be utilized to provide a stabilizing area that provides enhanced stability by providing stretchability in the coursewise direction and walewise direction.

According to one embodiment of the present invention, a bra blank is formed on circular knitting machine with a computerized electronic needle selection system. The outline of brassiere 10 is then formed in the seamless tubular blank with a sewing machine that simultaneously cuts away and finishes the periphery of the brassiere. The tubular bra blank is severed and finished at the center of the bra back, thereby forming two side panels 16 that are closable in an adjustable manner at the back of the wearer.

The body of the brassiere 10 is knit of an elastomeric, or stretch knitted fabric that may be made by varying combinations of cotton or polyester or nylon and spandex. Such yarns provide softness, comfort, and desired wicking properties. Brassiere 10 is preferably formed of a single layer of fabric. Alternately, brassiere 10 may have multiple peripherally joined layers.

Welt knit stitches may be used to provide special features at various locations. For example, the brassiere of the present invention may optionally have anchoring chest band 24 located along the bottom margin of brassiere 10. Such an anchoring chest band 24 is formed in the circular knitting process preferably as a turned welt. The fabric, which forms the turned welt, is knit on circular needles and dial bits in a well-known manner.

Underwire support may be provided by an arcuate underwire. The knitted in stabilizing areas 20 of the breast cups 12 provide direction for the placement of an underwire 26, which is separately attached to the breast cups 12. The underwire 26 may be disposed in an arcuate fabric tube, thereby providing increased comfort to the wearer. The stabilizing areas 20 of the breast cups 12 adjoin the underwire 26, thereby forming the bottom edges of the breast cups. In a multi-layer embodiment of the present invention, underwire 26 may be sandwiched between the layers of brassiere 10 and secured to the breast cups 12 by sewing, gluing or other fastening means.

In order to provide aesthetic and recognizable characteristics to a finished bra, the blank may have knitted-in patterns on the breast cups 12 and on the side panels 16. Such decorations may include floral, abstract or other designs.

The present invention has been described with particular reference to the preferred embodiments. It should be understood that the foregoing descriptions and examples are only illustrative of the invention. Various alternatives and modifications thereof can be devised by those skilled in the art without departing from the spirit and scope of the present invention. Accordingly, the present invention is intended to embrace all such alternatives, modifications, and variations that fall within the scope of the appended claims.

What is claimed is:

1. A circular knit bra comprising:

a pair of breast cups, each of said pair of breast cups having a bottom edge, each of said pair of breast cups having a stabilizing area knitted into each of said pair of breast cups and adjacent to each of said bottom edges;

a central gore being disposed between said pair of breast cups, wherein said central gore has a stabilizing area therein; and a pair of side panels, each of said pair of side panels being adjacent to a different one of said pair of breast cups.

2. The bra of claim 1, wherein each of said pair of breast cups further comprises a stabilizing area adjacent each of said bottom edge.

3. A circular knit bra comprising:

a pair of breast cups, each of said pair of breast cups having a bottom edge, each of said pair of breast cups having a stabilizing area adjacent to each of said bottom edges;

a central gore being disposed between said pair of breast cups, wherein said central gore has a stabilizing area therein; and a pair of side panels, each of said pair of side panels being adjacent to a different one of said pair of breast cups, wherein said stabilizing areas of each breast cup is formed using positive float stitches.

4. The bra of claim 3, wherein said stabilizing areas of each breast cup are formed using a 3×1 alternating positive float stitch on every course.

5. The bra of claim 3, wherein said stabilizing area of said central gore is formed using positive float stitches.

6. The bra of claim 3, wherein said stabilizing area of said central gore is formed using a 1×2 positive float stitch on every other course.

7. The bra of claim 3, further comprising a pair of shoulder straps, each of said shoulder straps being connected to a different one of said pair of breast cups and said pair of side panels.

8. The bra of claim 3, further comprising an underwire disposed approximate said bottom edge of each of said pair of breast cups.

9. The bra of claim 3, wherein said stabilizing area of each breast cup adjoins an underwire disposed adjacent said bottom edge of said breast cup.

10. The bra of claim 3, wherein said stabilizing area of said central gore is stretchable both walewise and coursewise.

11. The bra of claim 3, wherein said stabilizing area of said central gore forms a triangular area.

12. The bra of claim 3, wherein said stabilizing area of each of said breast cups is stretchable both walewise and coursewise.

13. The bra of claim 3, wherein said stabilizing areas of each of said breast cups act to support the breast.

14. The bra of claim 3, wherein said stabilizing area of each of said pair of breast cups is crescent shaped.

15. The bra of claim 3, further comprising a support for each of said pair of breast cups, wherein said support is formed from a heat shrinkage yarn in the bra.

16. A circular knit bra comprising:

a pair of breast cups, each of said pair of breast cups having a bottom edge, each of said pair of breast cups having a stabilizing area on said bottom edge;

a central gore being disposed between said pair of breast cups, wherein said central gore has a stabilizing area therein; and a pair of side panels, each of said pair of side panels being adjacent to a different one of said pair of breast cups, wherein said stabilizing areas of said central gore and each of said stabilizing areas of said pair of breast cups are formed using positive float stitches.

17. The bra of claim 16, wherein said stabilizing areas of said central gore are formed using a 1×2 positive float stitch on every other course.

18. The bra of claim 16, wherein said stabilizing area of each of said pair of breast cups is formed using a 3×1 alternating positive float stitch on every course.

19. A method of making a circular knit bra comprising the steps of:

knitting a series of courses defining a tubular bra blank, defining in said tubular bra blank a frontal torso portion having a pair of breast cups, each of said breast cups having a bottom edge, a central gore being disposed between said breast cups, and a pair of side panels, each of said pair of side panels being adjacent to a different one of said pair of breast cups;

knitting in a stabilizing area in said central gore;

knitting in a stabilizing area in said bottom edge of each of said pair of breast cups; and cutting a bra shape from said tubular bra blank.

20. The method of claim 19, further comprising finishing cut edges of said cut bra shape.

21. The method of claim 19, further comprising the steps of severing said tubular bra blank at a center back area, forming said side panels, and attaching fastening means to said side panels.

22. The method of claim 19, further comprising the step of attaching a pair of adjustable shoulder straps with each strap attached to a different one of said pair of breast cups and said side panels.

23. The method of claim 19, further comprising the step of securing an underwire at said bottom edge of each of said pair of breast cups.

* * * * *